United States Patent [19]

Boulton et al.

[11] 4,402,810

[45] Sep. 6, 1983

[54] BIPOLARLY CONNECTED ELECTROLYTIC CELLS OF THE FILTER PRESS TYPE

[75] Inventors: Thomas W. Boulton; Brian J. Darwent, both of Frodsham, England

[73] Assignee: Imperial Chemical Industries Limited, London, England

[21] Appl. No.: 263,738

[22] Filed: May 14, 1981

[30] Foreign Application Priority Data

May 15, 1980 [GB] United Kingdom ..... 8016023

[51] Int. Cl.[3] ..... C25B 9/04; C25B 13/08; C25B 11/03

[52] U.S. Cl. ..... 204/255; 204/257; 204/263; 204/284; 204/296

[58] Field of Search ..... 204/253, 254, 284, 255–256, 204/257–258, 295–296

[56] References Cited

U.S. PATENT DOCUMENTS

| | | | |
|---|---|---|---|
| 3,410,784 | 11/1968 | Maunsell | 204/268 |
| 3,766,044 | 10/1973 | Westerlund | 204/268 |
| 4,014,776 | 3/1977 | Giacopelli | 204/258 X |
| 4,204,939 | 5/1980 | Boulton et al. | 204/258 |
| 4,236,983 | 12/1980 | Minz et al. | 204/256 X |
| 4,252,628 | 2/1981 | Boulton et al. | 204/258 X |

FOREIGN PATENT DOCUMENTS

| | | |
|---|---|---|
| 2382518 | 9/1978 | France . |
| 2433592 | 3/1980 | France . |
| 1362127 | 7/1974 | United Kingdom . |
| 1479490 | 7/1977 | United Kingdom . |
| 733521 | 8/1980 | U.S.S.R. . |

*Primary Examiner*—Donald R. Valentine

*Attorney, Agent, or Firm*—Cushman, Darby & Cushman

[57] ABSTRACT

An electrolytic cell of the filter press type comprising a monopolar cell unit having a plurality of substantially vertical alternating anodes and cathodes each anode being partitioned from the adjacent cathode or cathodes by a separator to form in the cell unit a plurality of anode and cathode compartments, the electrolytic cell comprising two or more such units mounted one above the other, the anodes of the cell unit at the top or bottom being attached to electrical conductors, the cathodes of the cell unit at the bottom or top being attached to electrical conductors, and the anodes and cathodes of adjacent cell units which are not attached to the said conductors being connected by means of a bipolar electrical connection or connections between the anodes of one cell unit and the cathodes of the adjacent cell unit positioned above or below the said cell unit.

13 Claims, 4 Drawing Figures

BIPOLARLY CONNECTED ELECTROLYTIC CELLS OF THE FILTER PRESS TYPE

This invention relates to an electrolytic cell of the filter press type.

Monopolar electrolytic cells of the filter press type comprise a plurality of electrodes arranged as alternating anodes and cathodes each anode being partitioned from the adjacent cathode or cathodes by means of a separator to form in the cell a plurality of separate anode compartments and cathode compartments. The anode compartments of the cell are provided with means for feeding electrolyte to the cell, suitably from a common header, and with means for removing products of electrolysis from the cell. Similarly, the cathode compartments of the cell are provided with means for removing products of electrolysis from the cell, and optionally with means for feeding water or other fluid to the cell.

The electrolytic cell may be of the diaphragm or membrane type. In the diaphragm type cell the separators positioned between adjacent anodes and cathodes are microporous and in use the electrolyte passes through the diaphragms from the anode compartments to the cathode compartments of the cell. In the membrane type cell the separators are essentially hydraulically impermeable and in use ionic species are transported across the membranes between the anode compartments and the cathode compartments of the cell. The membranes are generally cation perm-selective.

Electrolytic cells of the aforementioned types may be used in the electrolysis of aqueous alkali metal chloride solutions. Where such a solution is electrolysed in an electrolytic cell of the diaphragm type the solution is fed to the anode compartments of the cell, chlorine which is produced in the electrolysis is removed from the anode compartments of the cell, the alkali metal chloride solution passes through the diaphragms and hydrogen and alkali metal hydroxide produced by electrolysis are removed from the cathode compartments, the alkali metal hydroxide being removed in the form of an aqueous solution of alkali metal chloride and alkali metal hydroxide. Where an aqueous alkali metal chloride solution is electrolysed in an electrolytic cell of the membrane type containing a cation perm-selective membrane the solution is fed to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution may be fed, and hydrogen and alkali metal hydroxide solution are removed from the cathode compartments of the cell.

Monopolar electrolytic cells of the filter press type may be used particularly in the production of chlorine and sodium hydroxide by the electrolysis of aqueous sodium chloride solution.

Such filter press type electrolytic cells may comprise a large number of alternating anodes and cathodes, for example, fifty anodes alternating with fifty cathodes, although the cell may comprise even more anodes and cathodes, for example up to one hundred and fifty alternating anodes and cathodes.

In a filter press electrolytic cell of the type hereinbefore described each anode in the cell is generally connected through a conductor of good electrical conductivity and of relatively massive dimensions to a common anode bus-bar, and each cathode is generally connected by such a conductor to a common cathode bus-bar. The electrical conductors are suitably made of copper, although other metals of good electrical conductivity may be used. In a filter press electrolytic cell it will be appreciated that where the cell comprises a large number of alternating anodes and cathodes there will be associated with the cell a large number of conductors of relatively massive dimensions. These conductors, particularly when made of copper, are expensive, and in view of the large number of such conductors which are required in a filter press electrolytic cell, the conductors represent a very significant proportion of the capital cost of such a cell. Furthermore, in use a small yet significant voltage drop is associated with each such conductor.

It would be of advantage to eliminate some at least of these electrical conductors of relatively massive dimensions in a monopolar electrolytic cell of the filter press type in order to decrease the capital cost associated with such a cell and in order to decrease the power losses which result from the voltage drop which is associated with each such conductor.

The present invention relates to an electrolytic cell of the filter press type in which the number of electrical conductors of relatively massive dimensions is reduced, with the consequent advantages hereinbefore described. Furthermore, the electrolytic cell of the present invention possesses the further advantage that the necessary floor area which is required in a cell room containing such a cell is much reduced when compared with the floor area required in a cell room containing the known type of electrolytic cell of the filter press type.

The present invention provides an electrolytic cell of the filter press type comprising a monopolar cell unit having a plurality of substantially vertical alternating anodes and cathodes each anode being partitioned from the adjacent cathode or cathodes by a separator to form in the cell unit a plurality of anode compartments and cathode compartments, characterised in that the electrolytic cell comprises two or more cell units mounted one above the other, the anodes of the cell unit at the top or bottom, as the case may be, being attached to electrical conductors for connection to a bus-bar, the cathodes of the cell unit at the bottom or top, as the case may be, being attached to electrical conductors for connection to a bus-bar, and the anodes and cathodes of adjacent cell units which are not attached to the said conductors being connected by means of a bipolar electrical connection or connections between the anodes of one cell unit and the cathodes of the adjacent cell unit positioned above or below the said cell unit, as the case may be.

We are aware that there have been prior proposals to mount electrolytic cell units one above the other. For example, there has been proposed in UK Pat. No. 1,479,490 an electrolytic apparatus comprising at least two electrolytic cells, each of which contains substantially vertical and parallel anode plates that alternate with substantially vertical and parallel cathodes connected to a wall of the cell, and each of which is in communication with a pipe for feeding-in an electrolyte for electrolysis and with pipes for removing products of electrolysis, wherein the cells are superimposed vertically one upon another and have their anodes connected in parallel to a common current collector.

The electrolytic cell of the present invention is distinguished from this latter previously proposed electrolytic apparatus in that in the latter apparatus each cell is of the so-called tank type containing a single anode compartment associated with a plurality of anodes and separated from a single cathode compartment associated with a plurality of interconnected cathode pockets or fingers by a suitable separator, whereas the cell units in the electrolytic cell of the present invention are of the filter press type comprising a plurality of anodes and cathodes partitioned from each other by separators to form a plurality of anode and cathode compartments. Furthermore, in this previously proposed electrolytic apparatus some of the anodes of adjacent cells are connected in parallel to a common current collector, whereas in the electrolytic cell of the present invention some of the anodes and cathodes of adjacent cells units are connected in a defined manner by means of a bipolar electrical connection or connections so that in use electrical current flow between anodes of one cell unit and the cathodes of the adjacent cell unit positioned above or below the said unit, as the case may be.

We are also aware of UK Pat. No. 1,362,127 in which there has been proposed a diaphragm electrolytic cell comprising a plurality of cell units mounted one on top of the other. In this cell the cell units are of the horizontal type and comprise anodes and cathodes which are electrically connected to plates which extend substantially horizontally. The units comprise a metal cathode frame, a metal cathode screen of wavy shape forming a series of upwardly extending ribs side by side with spaces between them extending across the cathode frame, and a metal bottom plate to which the cathode is electrically connected, and an anode frame with a horizontal back plate and anode blades or waves projecting between the ribs of the cathode screen. The electrolytic cell of the present invention is distinguished from this prior proposal as the cell units of the electrolytic cell of the present invention are of the filter press type comprising in each unit a plurality of anode compartments and cathode compartments, whereas the cell units of the previously proposed cell are of the tank type comprising, in each unit, a single anode compartment and a single cathode compartment. In the previously proposed cell the cell units are mounted one on top of the other with a bipolar connection between the cells. The preferred form of electical connection is provided by a corrugated cathode plate of one cell unit mating with a corrugated anode plate of an adjacent cell unit, the space between the plates being evacuated so that the plates may be held together in electrical contact. Before effecting the electrical contact the faces of the plates may be sand blasted and one or both faces may be sprayed with a soft metal, for example, copper, silver, lead, tin or aluminium. The electrical connection between the cell units of the present invention is much simpler than that of the previously proposed cell in that it does not require electrical connection to be achieved between the whole of the surfaces of anode plates and cathode plates as in the previously proposed cell, which may be difficult to achieve, nor does it require the application of a vacuum.

The anodes of one cell unit which are electrically connected to the cathodes of an adjacent cell unit in the electrolytic cell of the present invention may be so connected by means of relatively simple bipolar connections between individual anodes and cathodes. For example, the anodes and cathodes may be bolted, welded, or brazed together, or joined by means of a simple connecting piece, for example, a simple copper connector of relatively small dimensions.

Alternatively, the anodes of one cell unit which are electrically connected to the cathodes of an adjacent cell unit may be so connected by means of a common electrical conductor, for example to a copper conductor of relatively simple dimensions. The electrical connections are desirably as short as possible in order to minimise power losses. The electrical connections may be simple and in particular do not require the use of relatively massive section connectors, for example massive copper connectors. It is desirable to place between the anodes and cathodes at the point of connection a metal or alloy, e.g. a layer thereof, which is electrically conducting and which also provides a barrier to passage of hydrogen, for example copper or silver.

It will be appreciated that, whatever may be the particular connecting means chosen the electrolytic cell of the present invention in which cell units are mounted one above the other results in a decrease in the number of electrical conductors of relatively massive dimensions which are required for connection to bus-bars when compared with the number of such conductors required in an electrolytic cell of the filter press type of conventional design. Indeed, the number of such electrical conductors of relatively massive dimensions required is inversely proportional to the number of cell units which are mounted one above the other in the electrolytic cell of the invention.

Furthermore, the electrolytic cell of the invention possesses the additional advantage that the current flow between anodes and cathodes of adjacent cell units which are electrically connected may be in a relatively direct line, thus simplifying the connection. For this reason it is preferred that the anodes and cathodes in adjacent cell units which are electrically connected are positioned essentially in line one above the other so that the electrical connections may readily be made as simple as possible and so that the electrical current flows in as direct a line as possible. It will also be appreciated that as the cell units of the electrolytic cell are positioned one above the other the floor area required in a cell room, for an electrolytic cell of given productive capacity, is much reduced when compared with an electrolytic cell of the filter press type of conventional design in which cell units are arranged side by side on the same level in the cell room.

The number of cell units which it is desirable to mount one above the other in the electrolytic cell of the invention will depend on the dimensions of the individual cell units, particularly the heights of the cell units, and on the overall height which is desired in the electrolytic cell.

The electrolytic cell may for example comprise two cell units mounted one above the other, or even three or more cell units mounted one above the other.

In the case where the electrolytic cell comprises three cell units the anodes in the cell unit at the bottom may be attached to electrical conductors for connection to a bus-bar, the cathodes in the cell unit at the top may be attached to electrical conductors for connection to a bus-bar, and the anodes and cathodes in the middle cell unit may be electrically connected respectively to the cathodes in the cell unit at the bottom and to the anodes in the cell unit at the top.

Alternatively, where the electrolytic cell comprises three cell units the anodes in the cell unit at the top may be attached to electrical conductors for connection to a bus-bar, the cathodes in the cell unit at the bottom may be attached to electrical conductors for connection to a bus-bar, and the anodes and cathodes in the middle cell unit may be electrically connected respectively to the cathodes in the cell unit at the top and to the anodes in the cell unit at the bottom.

The simplest arrangement of the electrolytic cell of the invention is that comprising two cell units one mounted above the other. In this case the anodes in the lower cell unit may be attached to electrical conductors for connection to a bus-bar, the cathodes in the upper cell unit may be attached to electrical conductors for connection to a bus-bar, and the cathodes of the lower cell unit may be electrically connected to the anodes in the upper cell unit. Alternatively, the anodes in the upper cell unit may be attached to electrical conductors for connection to a bus-bar, the cathodes in the lower cell unit may be attached to electrical conductors for connection to a bus-bar, and the cathodes in the upper cell unit may be electrically connected to the anodes in the lower cell unit.

The anode compartments of each of the cell units will be provided with means for feeding electrolyte to the compartments, suitably from a common header, and with means for removing products of electrolysis from the compartments. Similarly, the cathode compartments of each of the cell units will be provided with means for removing products of electrolysis from the compartments, and optionally with means for feeding water or other fluid to the compartments.

For example, where the cell is to be used in the electrolysis of aqueous alkali metal chloride solution the anode compartments of each of the cell units will be provided with means for feeding the aqueous alkali metal chloride solution to the anode compartments and with means for removing chlorine and optionally with means for removing depleted aqueous alkali metal chloride solution from the anode compartments, and the cathode compartments of each of the cell units will be provided with means for removing hydrogen and cell liquor containing alkali metal hydroxide from the cathode compartments, and optionally, and if necessary, with means for feeding water or dilute alkali metal hydroxide solution to the cathode compartments.

The electrolytic cell may be of the diaphragm or membrane type. In the diaphragm type cell the separators positioned between adjacent anodes and cathodes to form separate anode compartments and cathode compartments in the cell units are microporous and in use the electrolyte passes through the diaphragms from the anode compartments to the cathode compartments. Thus, in the case where aqueous alkali metal chloride solution is electrolysed the cell liquor which is produced comprises an aqueous solution of alkali metal chloride and alkali metal hydroxide. In the membrane type electrolytic cell the separators are essentially hydraulically impermeable and in use ionic species are transported across the membranes between the compartments of the cell. Thus, where the membrane is a cation-exchange membrane cations are transported across the membrane, and in the case where aqueous alkali metal chloride solution is electrolysed the cell liquor comprises an aqueous solution of alkali metal hydroxide.

Where the separator to be used in the electrolytic cell is a microporous diaphragm the nature of the diaphragm will depend on the nature of the electrolyte which is to be electrolysed in the cell. The diaphragm should be resistant to degradation by the electrolyte and by the products of electrolysis and, where an aqueous solution of alkali metal chloride is to be electrolysed, the diaphragm is suitably made of a fluorine-containing polymeric material as such materials are generally resistant to degradation by the chlorine and alkali metal hydroxide produced in the electrolysis. Preferably, the microporous diaphragm is made of polytetrafluoroethylene, although other materials which may be used include, for example, tetrafluoroethylene-hexafluoropropylene copolymers, vinylidene fluoride polymers and copolymers, and fluorinated ethylene-propylene copolymers.

Suitable microporous diaphragms are those described, for example, in UK Pat. No. 1,503,915 in which there is described a microporous diaphragm of polytetrafluoroethylene having a microstructure of nodes interconnected by fibrils, and in UK Pat. No. 1,081,046 in which there is described a microporous diaphragm produced by extracting a particulate filler from a sheet of polytetrafluoroethylene. Other suitable microporous diaphragms are described in the art.

Where the separator to be used in the cell is a cation-exchange membrane the nature of the membrane will also depend on the nature of the electrolyte which is to be electrolysed in the cell. The membrane should be resistant to degradation by the electrolyte and by the products of electrolysis and, where an aqueous solution of alkali metal chloride is to be electrolysed, the membrane is suitably made of a fluorine-containing polymeric material containing cation-exchange groups, for example, sulphonic acid, carboxylic acid or phosphonic acid groups, or derivatives thereof, or a mixture of two or more such groups.

Suitable cation-exchange membranes are those described, for example, in UK Pat. Nos. 1,184,321, 1,402,920, 1,406,673, 1,455,070, 1,497,748, 1,497,749, 1,518,387 and 1,531,068.

The separators may be mounted on suitably shaped plates, which may act as sealing gaskets, positioned between adjacent anodes and cathodes, or alternatively the separators may merely be held in position between anodes and cathodes of the cell units. If desired the cell units may include spacing plates, which may act as sealing gaskets, positioned between the anodes and separators and/or between the cathodes and separators in order to provide in the cell units anode and cathode compartments having desired dimensions, and in particular desired anode-cathode gaps.

The spacing plates should be made of an electrically insulating material which is preferably resistant to the liquors and gases in the cell units. Suitable materials are fluorine-containing polymeric materials, although non-fluorinated materials may be used.

The materials of construction of the anodes and cathodes in the cell units of the electrolytic cell will depend on the nature of the electrolyte which is to be electrolysed in the cell. Thus, where aqueous alkali metal chloride solution is to be electrolysed the anode is suitably made of, or at least has an active area of, a film forming metal or alloy, for example of zirconium, niobium, tungsten or tantalum but preferably of, or at least an active area of, titanium, and the surface of the anode suitably carries a coating of an electroconducting electrocatalytically active material. The coating may comprise one or more platinum group metals, that is platinum, rhodium, iridium, ruthenium, osmium or palladium, and/or an oxide of one or more of these metals. The coating of platinum group metal and/or oxide may be present in admixture with one or more non-noble metal oxides, particularly one or more film-forming metal oxides, e.g. titanium dioxide. Electroconducting electrocatalytically active materials for use as anode coatings in an electrolytic cell for the electrolysis of aqueous alkali metal chloride solution, and methods of application of such coatings, are well known in the art.

The anode preferably is of foraminate construction and may, for example, be in the form of a perforated plate, a gauze or mesh, an expanded metal, or in the form of a plurality of elongated members, preferably substantially vertically disposed and parallel to each other, for example in the form of a plurality of louvres, blades or strips. The elongated members are conveniently produced from a sheet of film-forming metal by slitting the sheet and pressing-out the elongated members. For example, louvre slats so obtained may suitably be turned at right angles to the original plane of the film-forming metal sheet, or they may be inclined to this plane if desired. The louvred slats are preferably inclined at an angle of more than 60° to the plane of the anode sheet.

The cathodes of the electrolytic cell units may be formed of, or at least have an active area of, iron or mild steel or other suitable metal, for example nickle, and they may similarly be of foraminate construction, for example, in the form of a preforated plate, a gauze or mesh, an expanded metal, or a plurality of elongated members.

The individual anode compartments of the cell units will be provided with means for feeding electrolyte to the compartments and with means for removing the products of electrolysis from the compartments. Similarly, the individual cathode compartments of the cell units will be provided with means for removing the products of electrolysis from the compartments, and optionally with means for feeding water or other fluid to the compartments. Although it is possible for such means to be provided by separate pipes leading to or from each of the respective compartments such an arrangement would be unnecessarily complicated and cumbersome, and in a preferred embodiment of the electrolytic cell the cell units are made up of anode plates having an active metallic anode portion, cathode plates having an active metallic cathode portion, separators optionally mounted on plates, and optionally spacing plates, the plates, and separators when not mounted on plates, having a plurality of openings therein which in the cell units define separate compartments lengthwise of the cell units from which the electrolyte may be fed to the anode compartments of the cell units and through which the products of electrolysis may be removed from the anode and cathode compartments of the cell units.

Where the cell unit comprises hydraulically permeable diaphragms there may be two or three openings in the plates which define two or three compartments lengthwise of the cell unit from which electrolyte may be fed to the anode compartments of the cell unit and through which the products of electrolysis may be removed from anode and cathode compartments of the cell unit.

Where the cell unit comprises cation permselective membranes there may be four openings in the plates which define four compartments lengthwise of the cell unit from which electrolyte and water or other fluid may be fed respectively to the anode and cathode compartments of the cell unit and through which the products of electrolysis may be removed from the anode and cathode compartments of the cell unit.

The compartments lengthwise of the cell unit may communicate with the anode compartments and cathode compartments of the cell unit via channels in the plates, e.g in the faces or walls of the plates, suitably in the spacing plates.

The plates are suitably flexible, and are preferably resilient, as flexibility and resiliency aids in the achievement of fluid tight seals when the cell units are assembled.

In the cell unit the compartments lengthwise of the cell unit which are in communication with the anode compartments of the unit should be insulated electrically from the compartments lengthwide of the cell unit which are in communication with the cathode compartments of the unit.

This electrical insulation may be achieved in a variety of ways. For example, the openings in each of the plates may be defined by an electrically insulating material. Thus, the spacing plates, if present, may be in the form of a frame member of an electrically insulating material in which the openings which in the cell unit form a part of the compartments lengthwise of the cell unit are defined by openings in the frame member. Similarly, the anodes and cathodes of the cell unit may each be positioned in and supported by frame member of an electrically insulating material in which the openings which in the cell unit form a part of the compartments lengthwise of the cell unit are defined by openings in the frame member.

If desired, the function of spacing plate and support for an anode or cathode may be provided by a suitably shaped single frame member.

Alternatively, the anodes and cathodes of the cell units may be made in part of electrically insulating material and may be in part metallic. The openings in the plates which in the cell unit form a part of the compartments lengthwise of the cell unit may be formed in the metallic part of the anode or cathode plate and in a part of the plate which is made of an electrically insulating material so that the desired electrical insulation of the lengthwise compartments is achieved.

The spacing plates should be made of an electrically insulating material. The electrically insulating material is desirably resistant to the liquors in the cell units, and is suitably a fluorine-containing polymeric material.

Suitable filter press type electrolytic cells which may form cell units in the electrolytic cell of the present invention are described in published West German patent applications Nos. 2809333, which describes a diaphragm cell, and 2809332 which describes a membrane cell.

The invention will now be described with the aid of the following drawings.

Figure 1:
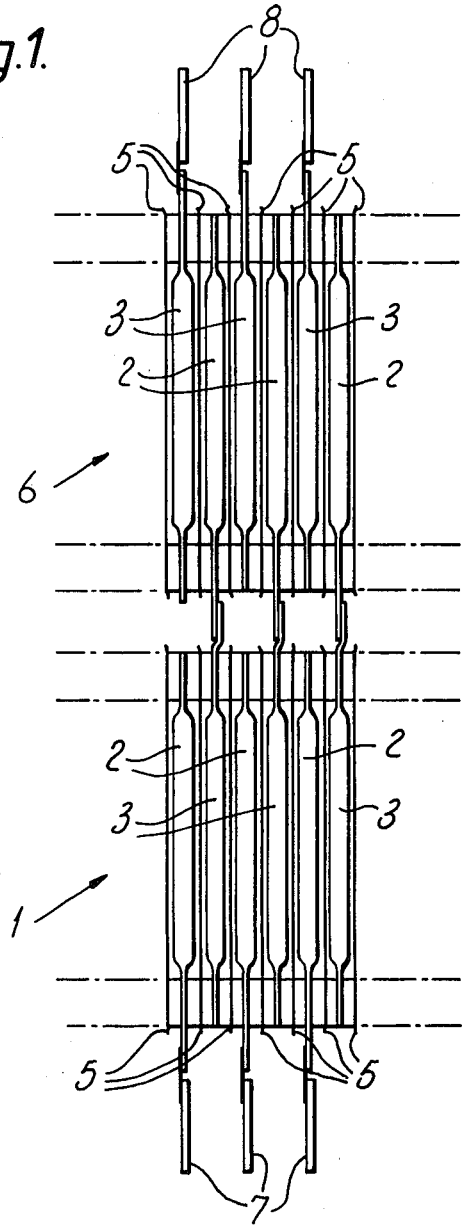
FIG. 1 is a diagrammatic representation of a part of an electrolytic cell comprising two monopolar cell units one mounted above the other.

Referring to FIG. 1 the electrolytic cell comprises a lower cell unit 1 having a plurality of louvred cathodes 2 alternating with a plurality of louvred anodes 3, and a cation-exchange membrane 5 positioned between each adjacent anode and cathode to divide the cell unit into a plurality of anode compartments and cathode compartments. Similarly the upper cell unit 6 comprises a plurality of louvred cathodes 2 alternating with a plurality of louvred anodes 3, and a cation-exchange membrane positioned between each adjacent anode and cathode to divide the cell unit into a plurality of anode compartments and cathode compartments.

Each cathode 2 in the lower cell unit 1 is positioned below an anode 3 in the upper cell unit 6, each of the cathodes 2 in the lower cell unit 1 are attached to a conductor 7, which may be of copper, for connection to a cathode bus-bar, and each of the anodes 3 in the upper cell unit 6 are attached to a conductor 8, which may be of copper, for connection to an anode bus-bar. The attachments between the cathodes and conductors, and between the anodes and conductors, may be made by any suitable means, for example as in the embodiment of FIG. 3 by bolting the conductor to a projecting flange on the cathode or anode as the case may be.

Each anode 3 in the lower cell unit 1 is positioned below a cathode 2 in the upper cell unit 6, and each anode 3 is electrically connected to the cathode 2 positioned immediately above by any suitable means, for example as in the embodiment of FIG. 2 by bolting together a flange on the cathode to an adjacent flange on the anode. A strip of electrically-conducting material resistant to passage of hydrogen, for example copper or silver, may be positioned between the cathode and associated anode at the point of connection in order to ensure good electrical connection and in order to decrease the diffusion of hydrogen from the cathode to the anode.

The cathodes 3 may be made of mild steel, nickel or other suitable metal, and the anodes 2 may be made of a film-forming metal, e.g. titanium, and may have a coating of an electroconducting electrocatalytically active material. The embodiment of the electrolytic cell shown in FIG. 1 is merely a diagrammatic representation and is intended in particular to show the electrical connections in the electrolytic cell and the arrangement of the cathodes and anodes of one cell unit with respect to the anodes and cathodes of the other cell unit. The means for feeding the electrolyte to the cell and the means for removing the products of electrolysis from the cell are not shown.

In operation of the electrolytic cell electrolyte is charged to the anode compartments of the cell units, depleted electrolyte is removed from the anode compartments of the cell units, and the products of electrolysis are removed from the anode and cathode compartments of the cell units. For example, where the electrolyte is an aqueous alkali metal chloride solution, the solution is charged to the anode compartments of the cell units and chlorine and depleted alkali metal chloride solution are removed from the anode compartments, and hydrogen and aqueous alkali metal hydroxide solution are removed from the cathode compartments of the cell units. The cell units may also be provided with means for feeding water to the cathode compartments of the cell units.

In operation electrical current flows from conductors 7 of the lower cell unit 1 to cathode 2 of the lower cell unit, then through membranes 5 to the anodes 3 positioned on either side of the cathodes 2, from the anodes 3 of the lower cell unit to cathodes 2 of the upper cell unit 6, from the cathodes 2 of the upper cell unit through the membranes 5 to the anodes 3 of the upper cell unit, and finally from the anodes 3 to a conductors 8 of the upper cell unit 6.

Figure 2:
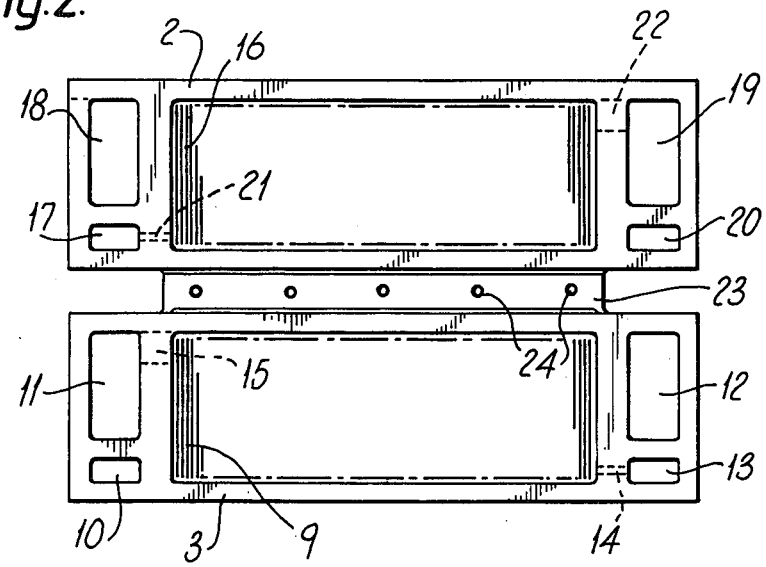
FIG. 2 shows an anode of the lower cell unit of FIG. 1 and the associated cathode of the upper cell unit positioned immediately above the anode.

FIG. 2 shows an anode 3 of the lower cell unit 1 and the associated cathode 2 of the upper cell unit 6 positioned immediately above the anode. The anode 3 comprises a plurality of vertically disposed louvres 9, and four openings 10, 11, 12 and 13 which, when the anodes 3 and the associated cathodes 2 and membranes 5, which have similar openings, are assembled into a cell unit define four compartments running lengthwise of the cell unit. In the anode 3 the opening 13, which form a part of a compartment lengthwise of the cell unit through which electrolyte may be charged to the cell, is in communication with the louvred part 9 of the anode 3, and thus the anode compartments, by means of a channel 14 in the face of the anode. The opening 11, through which depleted electrolyte and products of electrolysis may be removed from the anode compartments of the cell unit, is in communication with the louvred part 9 of the anode 3, and thus with the anode compartments, by means of a channel 15 in the face of the anode. At least the anode part comprising the louvres 9 is metallic. The part defining the openings 10, 11, 12, 13 may be of an electrically insulating material, for example a metallic anode part comprising the lourves 9 may be inserted in a gasket of an electrically insulating material which defines the openings 10, 11, 12, 13. Alternatively, those parts defining the openings 11 and 13 only may be of an electrically insulating material such that the openings 11 and 13 are electrically insulated from the openings 10 and 12, which may be defined by a metallic material.

The cathode 2 comprises a plurality of vertically disposed louvres 16, and four openings 17, 18, 19 and 20 which, when the cathodes 2 and the associated anodes 3 and membranes 5, which have similar openings, are assembled into a cell unit define four compartments running lengthwise of the cell unit. In the cathode 2 the opening 17, which forms a part of a compartment lengthwise of the cell unit through which water may be charged to the cell unit, is in communication with the louvred part 16 of the cathode 2, and thus with the cathode compartments, by means of a channel 21 in the face of the cathode. The opening 19, through which products of electrolysis may be removed from the cathode compartments of the cell unit, is in communication with the louvred part 16 of the cathode 2, and thus with the cathode compartments, by means of a channel 22 in the face of the cathode. At least the cathode part comprising the louvres 16 is metallic. The part defining the openings 17, 18, 19, 20 may be of an electrically insulating material, for example a metallic cathode part comprising the louvres 16 may be inserted in a gasket of an electrically insulating material which defines the openings 17, 18, 19, 20. Alternatively, those parts defining the openings 17 and 19 only may be of an electrically insulating material such that the openings 17 and 19 are electrically insulated from the openings 18 and 20 which may be defined by a metallic material.

The compartments lengthwise of the cell units may be connected to suitable headers (not shown) from which electrolyte and water may fed to cell units and to suitable headers (not shown) to which the products of electrolysis may be passed from the cell units.

The anode 3 has a projecting flange 23 electrically connected to a corresponding flange (not shown) on the cathode 2 by means of bolts 24.

Figure 3:
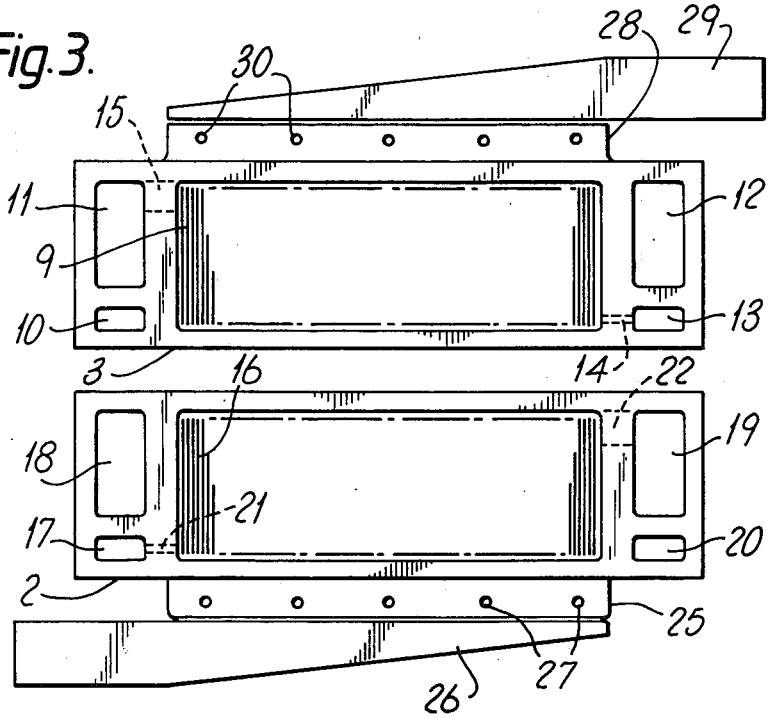
FIG. 3 shows a cathode of the lower cell unit of FIG. 1 and the associated anode of the upper cell unit positioned immediately above the cathode.

FIG. 3 shows a cathode 2 of the lower cell unit 1 and the associated anode 3 of the upper cell unit 6 positioned immediately above the cathode. The parts of the cathode 2 and the anode 3 of FIG. 3 which are the sae as those of the cathode 2 and anode 3 of FIG. 2 are indicated by like numerals. The cathode 2 of the lower cell unit 1 is provided with a flange 25 which is attached to a copper conductor 26 by means of bolts 27. Similarly, the anode 3 of the upper cell unit is provided with a flange 28 which is attached to a copper conductor 29 by means of bolts 30.

Figure 4:
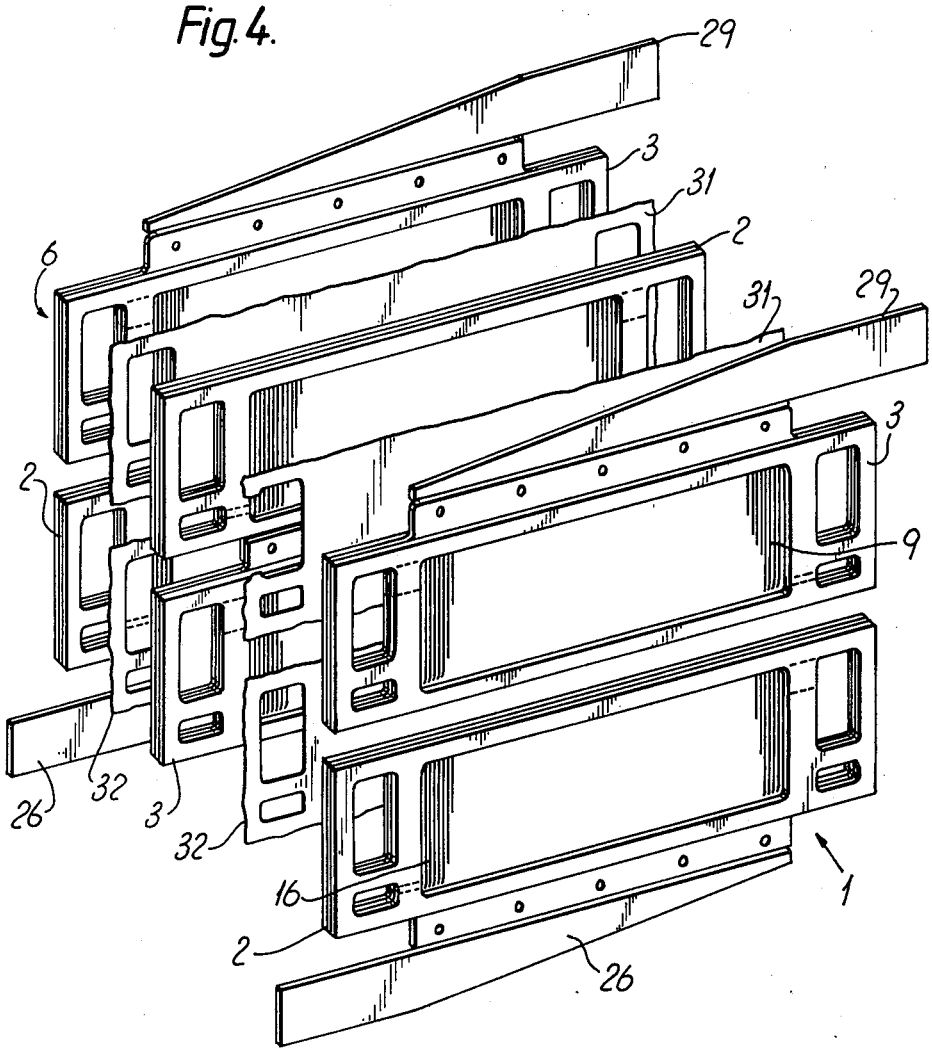
FIG. 4 is an isometric view of a part of the electrolytic cell of FIG. 1.

FIG. 4 is an isometric view of a part of the electrolytic cell of FIG. 1. Some of the reference numerals indicated in FIGS. 2 and 3 are used in FIG. 4 to indicate like parts, although for simplicity some of the reference numerals used in FIGS. 2 and 3 have been omitted. The electrolytic cell of FIG. 4 comprises a lower cell unit 1 and an upper cell unit 6. In the upper cell unit 6 an ion-exchange membrane 31 is positioned between the cathode 2 and each adjacent anode 3. The membrane 31 comprises openings corresponding to the openings 10, 11, 12 and 13 of the anode 3 in the upper cell unit and to the openings 17, 18, 19 and 20 in the cathode 2 of the upper cell unit. Similarly, in the lower cell unit 1 an ion-exchange membrane 32 is positioned between the anode 3 and each adjacent cathode 2. The membrane 32 comprises openings corresponding to the openings 17, 18, 19 and 20 in the cathode 2 of the lower cell unit and to the openings 10, 11, 12 and 13 of the anode 3 in the lower cell unit.

The electrolytic cell is assembled by fitting together, e.g by bolting, the anodes, cathodes and membranes of the cell units. If desired suitable deformable gaskets may be incorporated in order to ensure that the cell units are leak-tight although the use of such gaskets is not essential. The cell units will of course contain end plates which are not shown.

In order to electrolyse an aqueous alkali metal chloride solution the solution is charged from a header (not shown) to the compartment lengthwise of the lower cell unit formed in part by the openings 13 in the anodes 3 of the lower cell unit and to the compartment lengthwise of the upper cell unit formed in part by the openings 13 in the anodes 3 of the upper cell unit, and depleted aqueous alkali metal chloride solution and chlorine produced in the electrolysis are removed from the lower cell unit from the compartment lengthwise of the lower cell unit formed in part by the openings 11 in the anodes 3 of the lower cell unit and from the upper cell unit from the compartment lengthwise of the upper cell unit formed in part by the openings 11 in the anodes 3 of the upper cell unit.

During the electrolysis water or dilute alkali metal hydroxide solution is charged from a header (not shown) to the compartment lengthwise of the lower cell unit formed in part by the openings 17 in the cathodes 2 of the lower cell unit, and to the compartment lengthwise of the upper cell unit formed in part by the openings 17 in the cathodes 2 of the upper cell unit, and concentrated aqueous alkali metal hydroxide solution and hydrogen produced in the electrolysis are removed from the lower cell unit from the compartment lengthwise of the lower cell unit formed in part by the openings 19 in the cathodes 2 of the lower cell unit and from the upper cell unit from the compartment lengthwise of the upper cell unit formed in part by the openings 19 in the cathodes 2 of the upper cell unit.

We claim:

1. An electrolytic cell comprising a plurality of adjacently positioned monopolar cell units of the filter press type, each unit including a plurality of substantially vertical electrodes of alternating opposite polarity, said alternating electrodes being anodes and cathodes, each anode being partitioned from the adjacent cathode or cathodes by a separator to form in each cell unit a plurality of anode compartments and cathode compartments, characterized in that two or more cell units are mounted one above the other, the electrodes of like polarity in the uppermost cell unit being attached to electrical conductors for connection to a first bus bar, the electrodes in the lowermost cell unit which are of opposite polarity to the just-mentioned electrodes in the uppermost cell unit being attached to conductors for connection to a second bus bar, and the electrodes of adjacent cell units which are not attached to said electrical conductors being connected to each other by means of bipolar electrical connections.

2. An electrolytic cell as claimed in claim 1 characterised in that the anodes of one cell unit which are electrically connected to the cathodes of an adjacent cell unit are so connected by means of bipolar connections between individual anodes and cathodes.

3. An electrolytic cell as claimed in any one of claims 2 or 1 characterised in that the bipolar connection is made through a metal or alloy connector which is electrically conducting and which is resistant to the passage of hydrogen.

4. An electrolytic cell as claimed in any one of claims 2 or 1 characterized in that it comprises two cell units mounted one above the other.

5. An electrolytic cell as claimed in any one of claims 2 or 1 characterised in that in the cell units the separators are microporous diaphragms of a fluorine-containing polymeric material.

6. An electrolytic cell as claimed in any one of claims 2 or 1 characterised in that in the cell units the separators are cation-exchange membranes of a fluorine-containing polymeric material containing cation-exchange groups.

7. An electrolytic cell as claimed in claim 1 characterized in that the anodes of one cell unit which are electrically connected to the cathodes of an adjacent cell unit are so connected by means of bipolar connections to a common electrical conductor.

8. An electrolytic cell as claimed in claim 1 or claim 2 characterised in that the anodes and cathodes of adjacent cell units which are electrically connected are positioned essentially in line.

9. An electrolytic cell as claimed in claim 1 characterised in that the cell units comprise anode plates having a metallic anode portion and cathode plates having a metallic cathode portion, and in that the plates have a plurality of openings therein which in the cell units define a plurality of compartments lengthwise of the cell units through which electrolyte may be fed to the anode compartments of the cell units and through which the products of electrolysis may be removed from the anode and cathode compartments of the cell units.

10. An electrolytic cell as claimed in claim 9 characterised in that the cell units comprise spacing plates having a plurality of openings therein which in the cell units define a plurality of compartments lengthwise of the cell units.

11. An electrolytic cell as claimed in claim 9 characterised in that the plates are flexible.

12. An electrolytic cell as claimed in any one of claims 9, 10 or 11 characterised in that communication between the compartments lengthwise of the cell units and the anode and cathode compartments is provided by channels in the faces of the plates.

13. An electrolytic cell as claimed in claim 12 characterised in that channels are provided in the faces of the spacing plates.

* * * * *